US009718632B2

(12) United States Patent
Saeki

(10) Patent No.: US 9,718,632 B2
(45) Date of Patent: Aug. 1, 2017

(54) SHEET SUPPLY DEVICE AND IMAGE FORMING SYSTEM

(71) Applicant: Brother Kogyo Kabushiki Kaisha, Nagoya (JP)

(72) Inventor: Masahito Saeki, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 15/073,818

(22) Filed: Mar. 18, 2016

(65) Prior Publication Data

US 2017/0022019 A1 Jan. 26, 2017

(30) Foreign Application Priority Data

Jul. 24, 2015 (JP) ..... 2015-146645

(51) Int. Cl.
*B65H 5/00* (2006.01)
*B65H 3/06* (2006.01)

(52) U.S. Cl.
CPC ..... *B65H 3/0669* (2013.01); *B65H 3/0684* (2013.01); *B65H 2403/70* (2013.01); *B65H 2403/724* (2013.01); *B65H 2403/80* (2013.01)

(58) Field of Classification Search
CPC ..... B65H 1/00; B65H 1/04; B65H 2403/70; B65H 2403/72; B65H 2403/721; B65H 2403/722; B65H 2403/724; B65H 2403/80; B65H 2403/81; B65H 3/0669; B65H 3/0684
See application file for complete search history.

(56) References Cited

U.S. PATENT DOCUMENTS 4,958,822 A * 9/1990 Rutishauser ..... B65H 1/266 271/10.03
5,116,034 A * 5/1992 Trask ..... B65H 3/44 271/121
5,199,696 A * 4/1993 Kato ..... B65H 3/0669 271/10.13

(Continued)

FOREIGN PATENT DOCUMENTS

JP 62079139 A * 4/1987
JP H04-169432 A 6/1992

(Continued)

*Primary Examiner* — Prasad Gokhale
(74) *Attorney, Agent, or Firm* — Burr & Brown, PLLC

(57) ABSTRACT

A sheet supply device detachably attachable to an image forming apparatus includes: a main body; a sheet supply roller; an external output gear; a clutch mechanism; and first and second transmission mechanisms. The main body is provided with a sheet supply tray on which a sheet is mountable. The sheet supply roller is in contact with a sheet mounted on the sheet supply tray and configured to rotate to supply the sheet toward the image forming apparatus. The external output gear is configured to output a driving force to an outside. The clutch mechanism is configured to transmit and interrupt a driving force from the image forming apparatus. The first transmission mechanism is configured to transmit the driving force received through the clutch mechanism to the sheet supply roller. The second transmission mechanism is configured to transmit the driving force received through the clutch mechanism to the external output gear.

8 Claims, 7 Drawing Sheets

(56) References Cited

U.S. PATENT DOCUMENTS

| | | | | | |
|---|---|---|---|---|---|
| 5,485,990 | A * | 1/1996 | Kato | G03G 15/6502 | 271/9.08 |
| 5,678,814 | A * | 10/1997 | Yokoyama | B65H 3/44 | 271/117 |
| 8,657,278 | B2 * | 2/2014 | Ozeki | G03G 15/6502 | 271/10.04 |
| 8,672,315 | B2 * | 3/2014 | Goto | B65H 5/06 | 271/9.01 |
| 2013/0001855 | A1 * | 1/2013 | Ozeki | G03G 15/6502 | 271/9.01 |
| 2013/0127107 | A1 * | 5/2013 | Goto | B65H 5/06 | 271/9.01 |

FOREIGN PATENT DOCUMENTS

| | | | | |
|---|---|---|---|---|
| JP | 2008162736 A | * | 7/2008 | B65H 3/0669 |
| JP | 2013-010611 A | | 1/2013 | |

* cited by examiner

SHEET SUPPLY DEVICE AND IMAGE FORMING SYSTEM

CROSS REFERENCE TO RELATED APPLICATION

This application claims priority from Japanese Patent Application No. 2015-146645 filed Jul. 24, 2015. The entire content of the priority application is incorporated herein by reference.

TECHNICAL FIELD

The present disclosure relates to a sheet supply device, and an image forming system including the sheet supply device.

BACKGROUND

There is conventionally known a sheet supply device that receives a driving force from an image forming apparatus to supply a sheet to the image forming apparatus. In the sheet supply device, the driving force supplied from the image forming apparatus is transmitted to a sheet supply roller and another sheet supply device (hereinafter referred to as a second sheet supply device).

The second sheet supply device receives the driving force from the image forming apparatus through a sheet supply device which is directly assembled to the image forming apparatus (hereinafter referred to as a first sheet supply device), thereby supplying a sheet to the image forming apparatus.

Note that the first sheet supply device and the second sheet supply device are identical to each other in construction. That is, the second sheet supply device can be directly assembled to the image forming apparatus, and the first sheet supply device can receive the driving force from the image forming apparatus through the second sheet supply device to supply a sheet to the image forming apparatus.

SUMMARY

However, output gears of the first and second sheet supply devices are rotated upon rotation of a motor provided in the image forming apparatus. That is, the output gear of each of the first and second sheet supply devices is rotated in interlocking relation to the rotation of the motor.

In this case, the driving force is transmitted to the second sheet supply device even when the first sheet supply device supplies a sheet to the image forming apparatus. Thus, unwanted rotation occurs in the output gear of the second sheet supply device, which generates unwanted noise.

In view of the foregoing, it is an object of the disclosure to provide a sheet supply device capable of restraining generation of unwanted noise, the sheet supply device being capable of outputting a driving force to an external device.

In order to attain the above and other objects, according to one aspect, the disclosure provides a sheet supply device configured to be attached to and detached from an image forming apparatus, and configured to receive a driving force from the image forming apparatus to supply a sheet to the image forming apparatus in response to attachment of the sheet supply device to the image forming apparatus. The sheet supply device includes: a main body; a sheet supply roller; an external output gear; a clutch mechanism; a first transmission mechanism; and a second transmission mechanism. The main body is provided with a sheet supply tray on which a sheet is mountable. The sheet supply roller is configured to be in contact with a sheet mounted on the sheet supply tray and configured to rotate to supply the sheet toward the image forming apparatus. The external output gear is configured to output a driving force to an outside. The clutch mechanism is configured to transmit and interrupt the driving force from the image forming apparatus. The first transmission mechanism is configured to transmit the driving force received through the clutch mechanism to the sheet supply roller. The second transmission mechanism is configured to transmit the driving force received through the clutch mechanism to the external output gear.

According to another aspect, the disclosure provides an image forming system including: an image forming apparatus; and a sheet supply device. The image forming apparatus is configured to form an image on a sheet and provided with an output gear configured to output a driving force to an outside. The sheet supply device is configured to be attached to and detached from the image forming apparatus. The sheet supply device is configured to receive the driving force from the image forming apparatus to supply a sheet to the image forming apparatus in response to attachment of the sheet supply device to the image forming apparatus. The sheet supply device includes: a main body; a sheet supply roller; an external output gear; a first transmission mechanism; and a second transmission mechanism. The main body is provided with a sheet supply tray on which a sheet is mountable. The sheet supply roller is configured to be in contact with a sheet mounted on the sheet supply tray and configured to rotate to supply the sheet toward the image forming apparatus. The external output gear is configured to output a driving force to an outside. The clutch mechanism is configured to transmit and interrupt the driving force from the image forming apparatus. The first transmission mechanism is configured to transmit the driving force received through the clutch mechanism to the sheet supply roller. The second transmission mechanism is configured to transmit the driving force received through the clutch mechanism to the external output gear.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
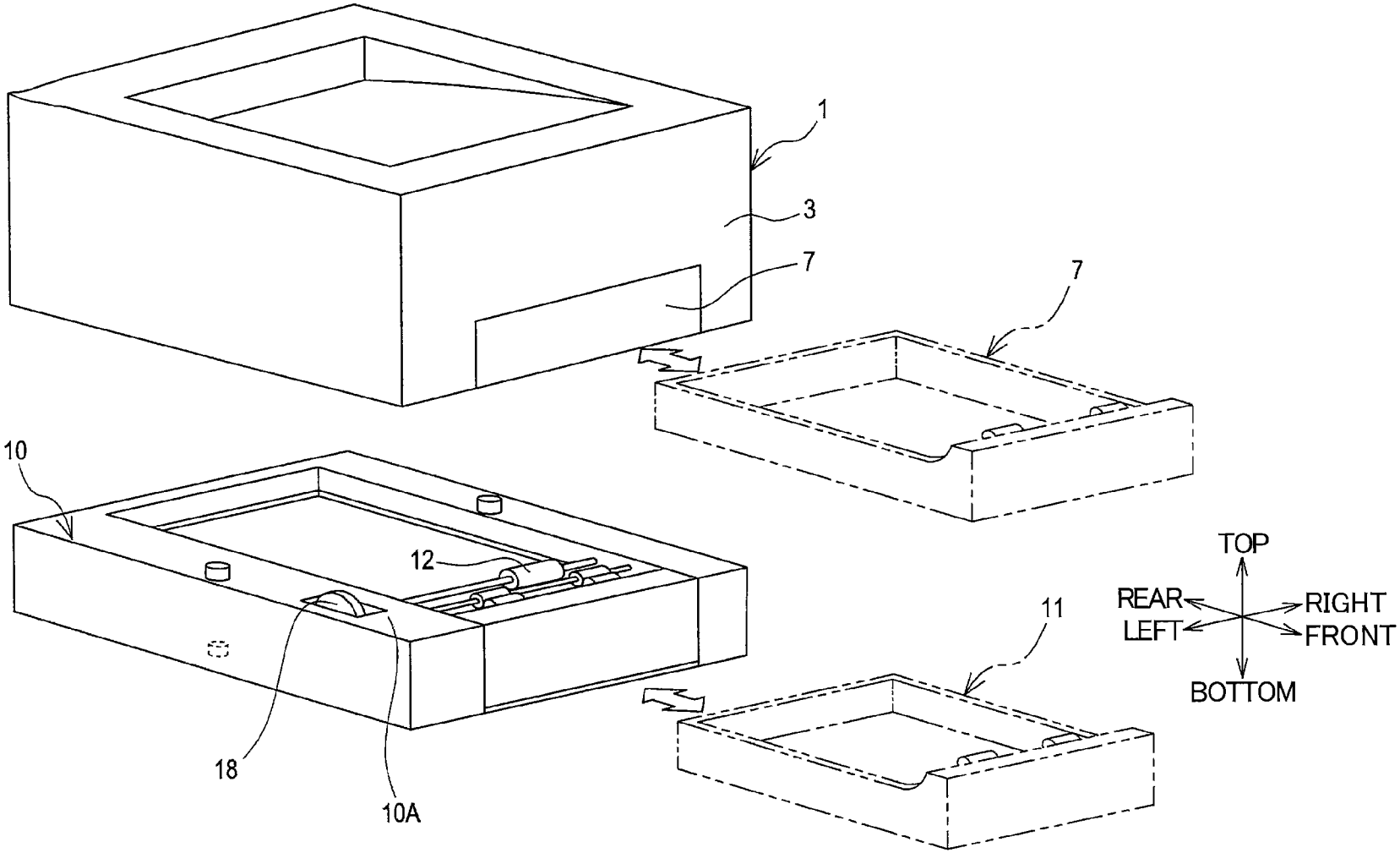
FIG. 1 is a schematic view of an image forming system according to one embodiment.

An image forming system including an electrophotographic-type image forming apparatus 1 and a sheet supply device 10 according to one embodiment will be described with reference to the accompanying drawings, wherein like parts and components are designated by the same reference numerals to avoid duplicating description.

As shown in FIG. 1, the sheet supply device 10 is an optional device that can be replenished afterward, and can be attached to and detached from the image forming apparatus 1.

In the following description, arrows indicative of directions in the drawings are for the purpose of facilitating understanding to the embodiment. The disclosure is not limited to the depicted directions. Further, a part or component to which a reference numeral is affixed implies "at least one" part or component, unless otherwise referred to as "a plurality of" and "not less than two".

First Embodiment

Figure 2:
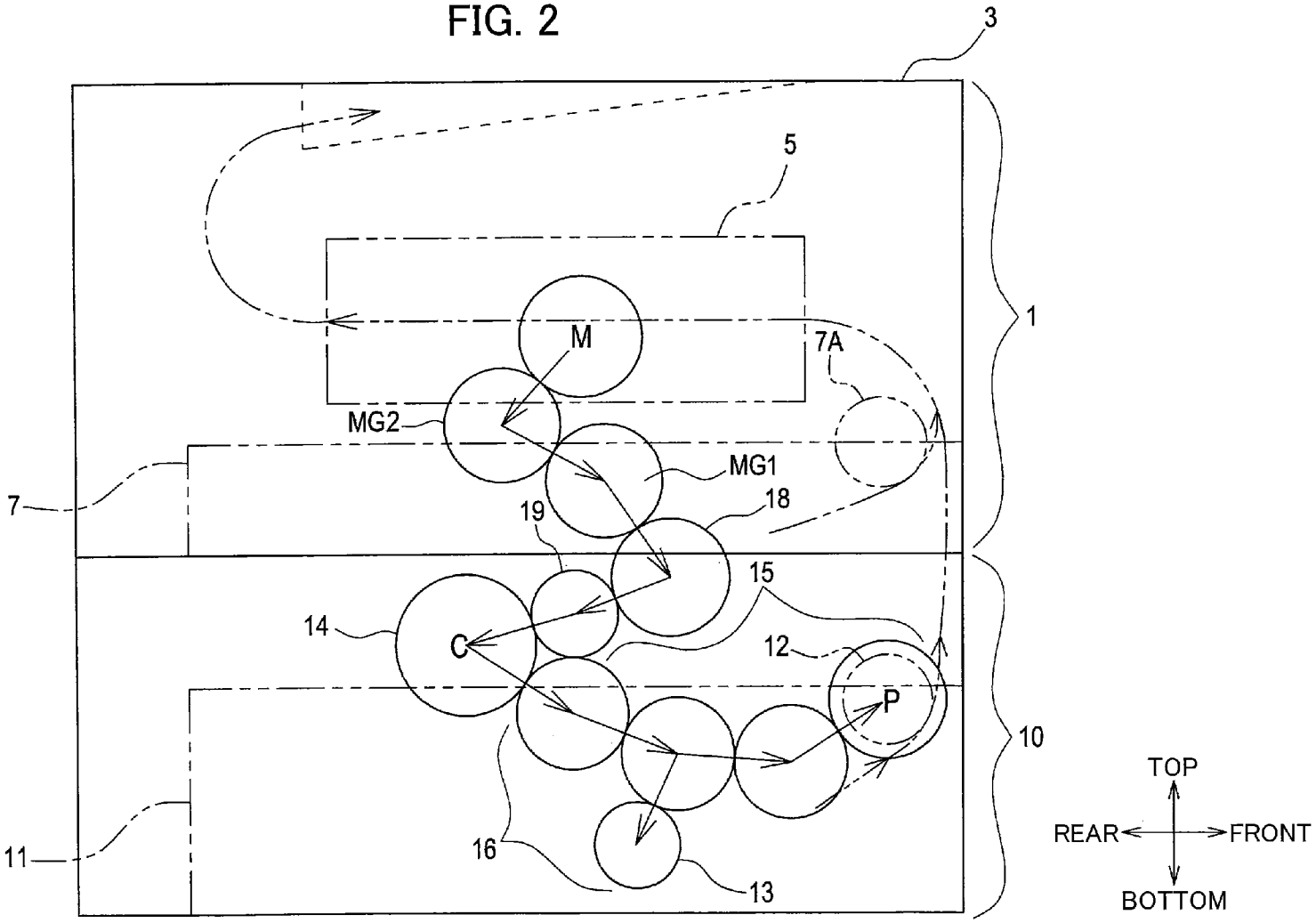
FIG. 2 is a view illustrating a power transmission route in the image forming system according to the embodiment.

1. Overall Structure of Image Forming Apparatus (FIG. 2)

The image forming apparatus 1 includes a main casing 3 and an image forming unit 5 provided therein. The image forming unit 5 is of an electrophotographic type in which an image is formed by transferring a developer image onto a sheet. A sheet supply tray 7 is attachable to and detachable from the main casing 3.

At least one sheet can be mounted on the sheet supply tray 7. A sheet supply roller 7A is provided in the main casing 3 for conveying a sheet placed on the sheet supply tray 7 toward the image forming unit 5. An electronic motor M is provided in the main casing 3.

The motor M is adapted to generate a driving force to be supplied to the sheet supply roller 7A. An output gear MG1 is provided at a lower portion of the main casing 3. The output gear MG1 is adapted to output a driving force from the motor M to the sheet supply device 10. One or a plurality of gears MG2 are provided to transmit the driving force from the motor M to the output gear MG1.

The output gear MG1 is rotatable in interlocking relation to the rotation of the motor M. That is, the output gear MG1 is rotated in response to energization of the motor M, and the rotation of the output gear MG1 is stopped in response to de-energization of the motor M.

2. Sheet Supply Device

Figure 3:
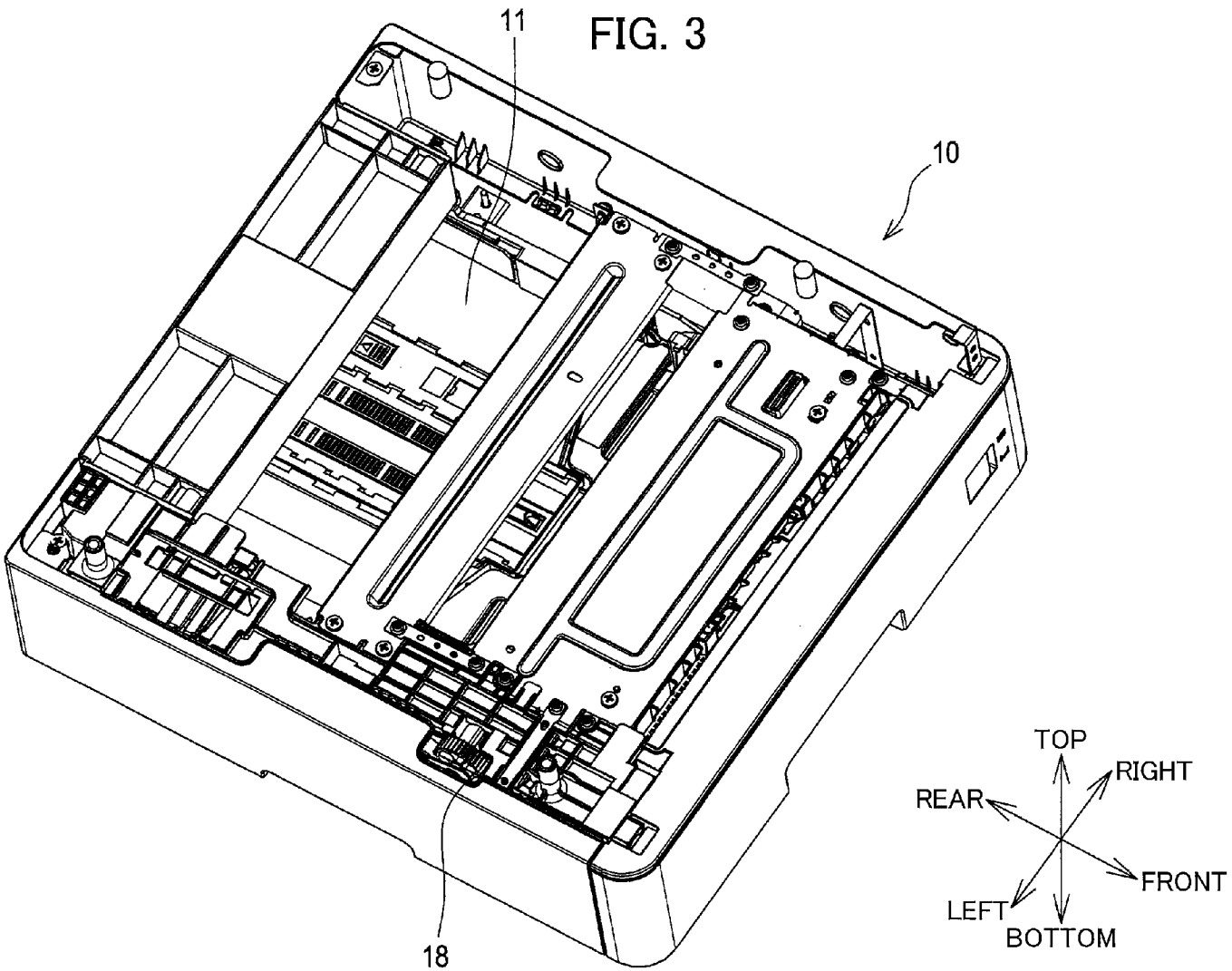
FIG. 3 is a perspective view of a sheet supply device 10 according to the embodiment.

The sheet supply device 10 is adapted to supply a sheet to the image forming apparatus 1 upon receipt of the driving force from the image forming apparatus 1 through the output gear MG1. The sheet supply device 10 includes a main body, and a sheet supply tray 11 provided in the main body, as shown in FIG. 3. The sheet supply tray 11 is capable of accommodating at least one sheet.

The main body of the sheet supply device 10 is constituted by segments such as a casing and components that are not subjected to de-assembling, assembling, attachment, or detachment by a user during normal use of the sheet supply device 10. Note that the sheet supply tray 11 can be attached to and detached from the casing of the sheet supply device 10.

As shown in FIG. 2, the main body is provided with a sheet supply roller 12, an external output gear 13, a clutch mechanism 14, a first transmission mechanism 15, and a second transmission mechanism 16. The sheet supply roller 12 is adapted to rotate to supply a sheet mounted on the sheet supply tray 11 toward the image forming apparatus 1 while the sheet supply roller 12 is in contact with the sheet.

The external output gear 13 is adapted to output the driving force to an external device such as another sheet supply device. The external output gear 13 has a module and the number of teeth identical to those of the output gear MG1.

The clutch mechanism 14 is adapted to intermittently transmit the driving force from the image forming apparatus 1 to the first transmission mechanism 15 and the second transmission mechanism 16 through the output gear MG1. The clutch mechanism 14 is an electromagnetic clutch that intermittently transmits the driving force using an electromagnetic force. In FIG. 2, the clutch mechanism 14 is also denoted by a reference sign "C".

Figure 4:
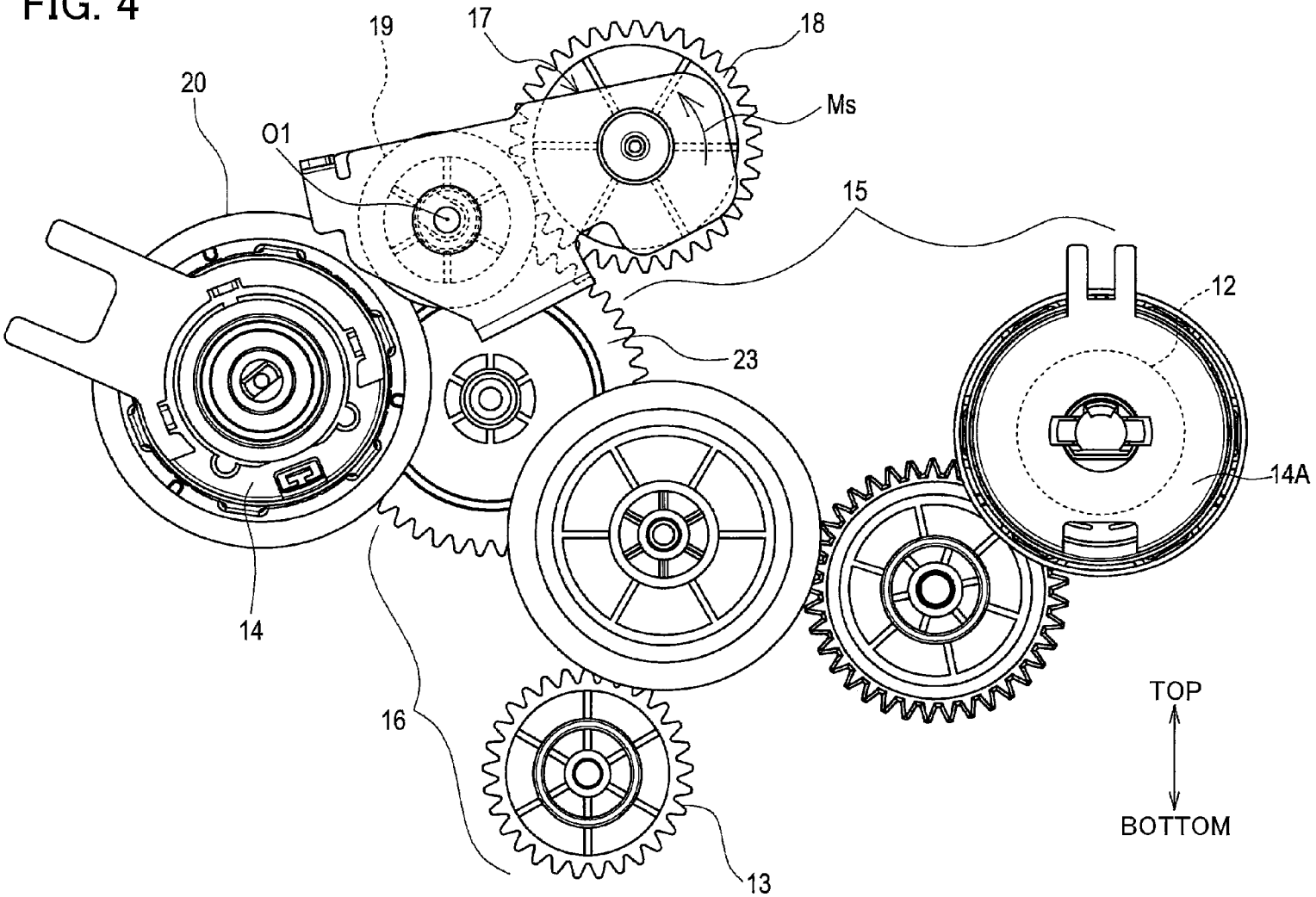
FIG. 4 is a view showing a first transmission mechanism 15, a second transmission mechanism 16, and a clutch mechanism 14 provided in the sheet supply device 10 according to the embodiment.

The first transmission mechanism 15 is adapted to transmit the driving force received from the clutch mechanism 14 to the sheet supply roller 12, as shown in FIG. 4. The driving force transmitted to the sheet supply roller 12 is denoted by a reference sign "P" in FIG. 2. The first transmission mechanism 15 is a gear mechanism including one or a plurality of gears.

The first transmission mechanism 15 includes a second clutch mechanism 14A adapted to intermittently transmits the driving force to be transmitted to the sheet supply roller 12. That is, rotation and stopping of the sheet supply roller 12 is controlled by on/off of the second clutch mechanism 14A. The second clutch mechanism 14A is an electromagnetic clutch.

The second transmission mechanism 16 is adapted to transmit the driving force received from the clutch mechanism 14 to the external output gear 13, as shown in FIG. 2. The second transmission mechanism 16 is a gear mechanism including one or a plurality of gears.

A pivot arm 17 has one longitudinal end portion that is pivotally movably supported to the main body (see a pivot axis O1 in FIG. 4). A first input gear 18 is provided at another longitudinal end portion of the pivot arm 17. The first input gear 18 is adapted to meshingly engage with the output gear MG1 when the sheet supply device 10 is attached to the image forming apparatus 1 (see FIG. 2).

Figure 5:
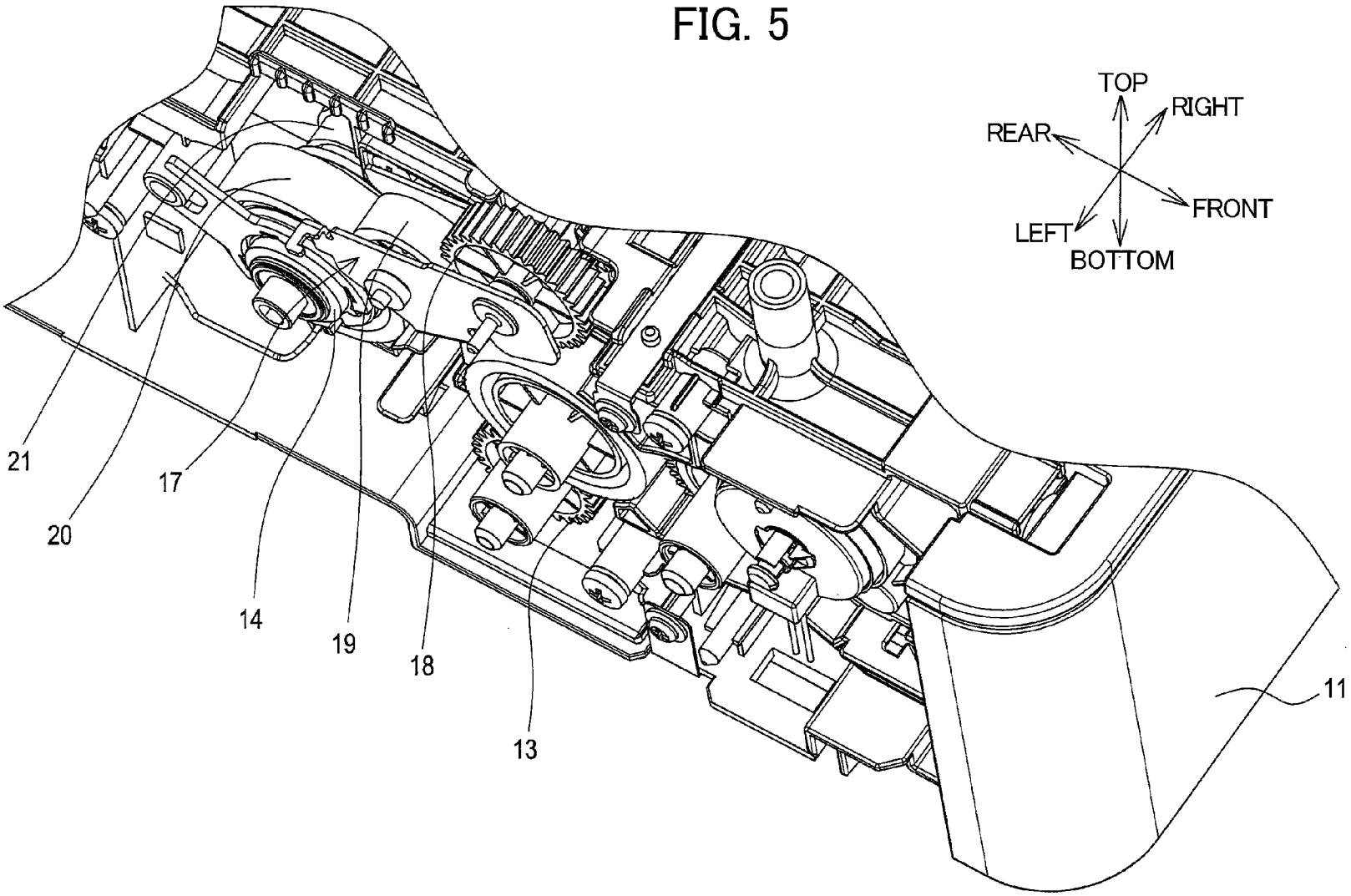
FIG. 5 is a partial perspective view showing the first transmission mechanism 15, the second transmission mechanism 16, and the clutch mechanism 14 in the sheet supply device 10 according to the embodiment.

As shown in FIG. 5, the external output gear 13, the gears constituting the first and second transmission mechanisms 15, 16, the clutch mechanism 14, and the second clutch mechanism 14A are rotatably supported to the main body of the sheet supply device 10.

A moment directing in a direction Ms indicated by an arrow in FIG. 4 is applied to the pivot arm 17 by a spring (not shown). This direction Ms is a direction in which the first input gear 18 approaches the output gear MG1.

Figure 6:
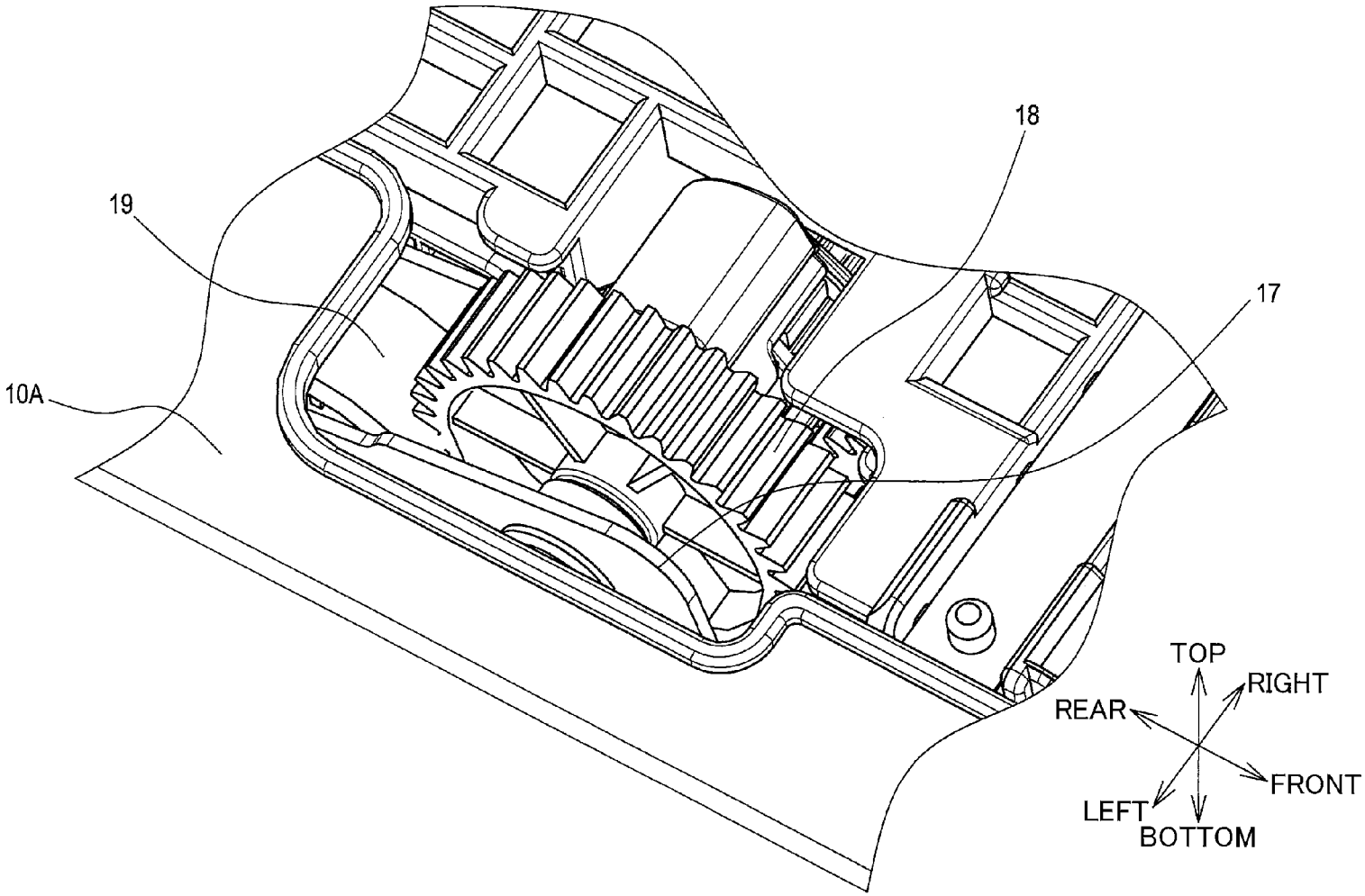
FIG. 6 is a perspective view particularly showing a first input gear 18 provided in the sheet supply device 10 according to the embodiment.

Therefore, when the first input gear 18 is disengaged from the output gear MG1, that is, when the sheet supply device 10 is not attached to the image forming apparatus 1, a part of the first input gear 18 protrudes from an upper surface 10A of the casing of the sheet supply device 10 as shown in FIG. 6.

Upon attachment of the sheet supply device 10 to the image forming apparatus 1 to configure the image forming system, the first input gear 18 and the output gear MG1 are meshedly engaged with each other as shown in FIG. 2, and the first input gear 18 is moved downward from a state shown in FIG. 1.

As shown in FIG. 4, a second input gear 19 is provided at the pivot arm 17 such that the second input gear 19 is coaxial with the pivot axis O1 of the pivot arm 17. The second input gear 19 is always in meshing engagement with the first input gear 18. That is, a rotational axis of the first input gear 18 is angularly movable about a rotational axis of the second input gear 19.

A third input gear 20 is supported to the main body of the sheet supply device 10, and is in always meshing engagement with the second input gear 19. The third input gear 20 has a diameter greater than that of the second input gear 19, and the first input gear 18 has a diameter greater than that of the second input gear 19.

Figure 7:
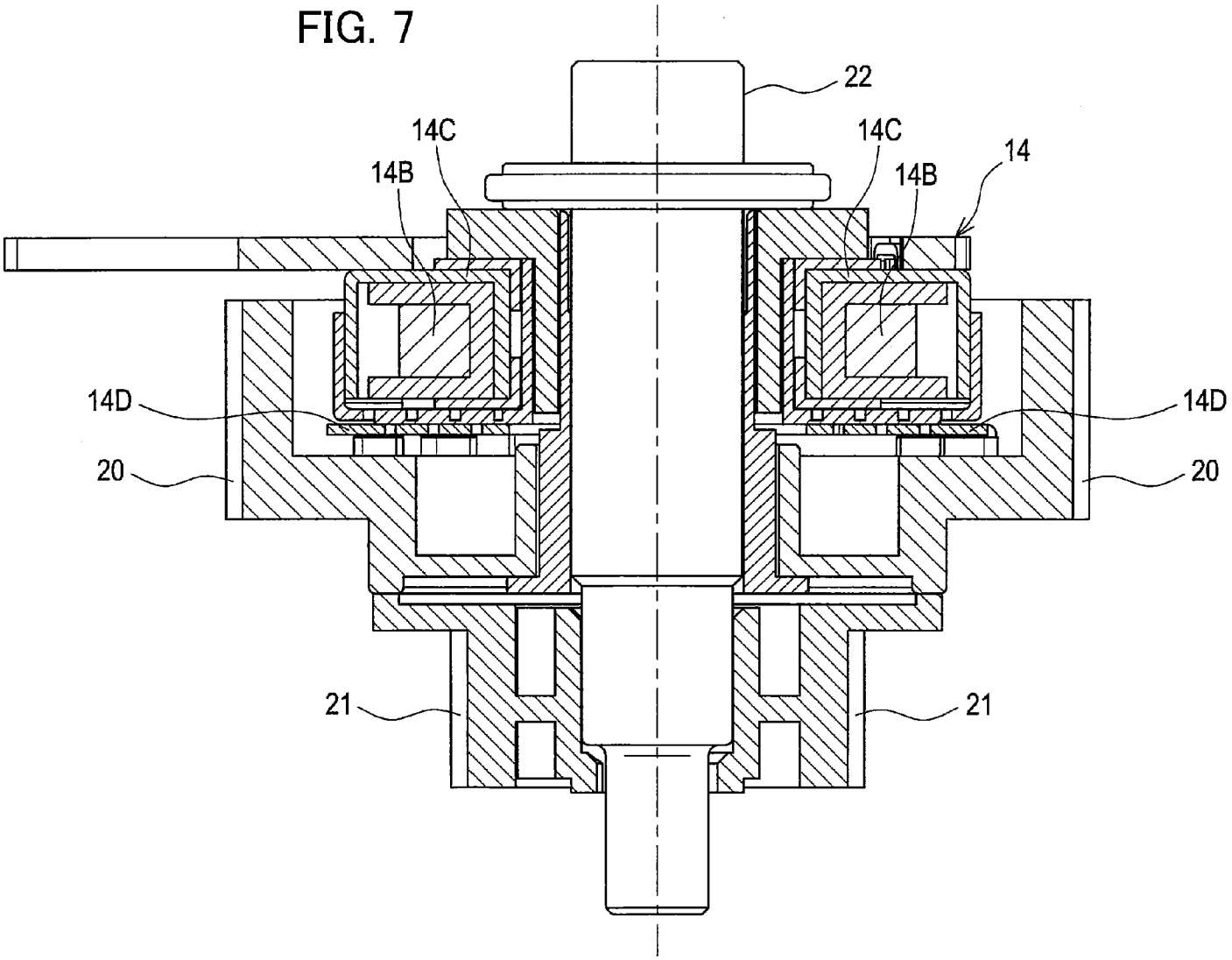
FIG. 7 is a cross-sectional view particularly showing the clutch mechanism 14 of the sheet supply device 10 according to the embodiment.

As shown in FIG. 7, the clutch mechanism 14 is provided coaxially with the third input gear 20. That is, the second input gear 19 is rotatable relative to a shaft 22. The shaft 22 is rotatable relative to the main body.

A transmission gear 21 is locked with the shaft 22, and is rotatable along with the shaft 22. Thus, the transmission gear 21 is positioned coaxially with the third input gear 20. That is, a rotation axis of the transmission gear 21 is coincident with a rotation axis of the third input gear 20.

The transmission gear 21 is adapted to transmit the driving force to the first transmission mechanism 15 and the second transmission mechanism 16. More specifically, the transmission gear 21 is always in meshing engagement with a second transmission gear 23 (FIG. 4). The second transmission gear 23 constitutes a part of the first transmission mechanism 15 and a part of the second transmission mechanism 16.

The transmission gear 21 has a diameter different from that of the third input gear 20. More specifically, the diameter of the third input gear 20 is greater than that of the transmission gear 21. The clutch mechanism 14 is accommodated in the third input gear 20 whose diameter is greater than that of the transmission gear 21.

The clutch mechanism 14 includes an exciting coil 14B, a yoke 14C, and a movable segment (armature) 14D. The exciting coil 14B is adapted to induce a magnetic field upon electric power supply. The yoke 14C is made from a ferromagnetic material. The yoke 14C is adapted to aggregate the magnetic field induced by the exciting coil 14B to the movable segment 14D.

The exciting coil 14B and the yoke 14C are connected to the shaft 22, and are rotatable integrally with the rotation of the shaft 22. The movable segment 14D is made from a ferromagnetic material. The movable segment 14D is connected to the third input gear 20 and rotatable integrally with the rotation of the third input gear 20.

Upon electric power supply to the exciting coil 14B, an electromagnetic attraction force is generated between the yoke 14C and the movable segment 14D by the induced magnetic field. Thus, the movable segment 14D is attracted to the yoke 14C as shown in FIG. 7, so that the movable segment 14D and the yoke 14C are rotated together to transmit the rotation of the third input gear 20 to the shaft 22.

That is, upon electric power supply to the exciting coil 14B, the driving force is transmitted from the third input gear 20 to the first transmission mechanism 15 and the second transmission mechanism 16 through the clutch mechanism 14. On the other hand, transmission of the driving force is interrupted when the electric power supply to the exciting coil 14B is stopped.

3. Features in Image Forming System (Particularly, Sheet Supply Device) According to Embodiment According to the embodiment described above, transmission of the driving force to the first and second transmission mechanisms 15, 16 can be interrupted by the clutch mechanism 14. Accordingly, noise due to operations of the first and second transmission mechanisms 15, 16 can be reduced, and load imparted on the drive source in the image forming apparatus 1 can be reduced.

That is, transmission of the driving force to the first and second transmission mechanisms 15, 16 can be shut off by the clutch mechanism 14 when supply of sheets from the sheet supply device 10 to the image forming apparatus 1 is not performed. Therefore, operations of the first and second transmission mechanisms 15, 16 can be prevented when no sheet is supplied from the sheet supply device 10 to the image forming apparatus 1. Accordingly, unnecessary rotation of gears can be prevented, thereby restraining unnecessary generation of noise and reducing unnecessary load application to the drive source.

Incidentally, if a plurality of sheet supply devices 10 is assembled to the image forming apparatus 1, the clutch mechanism 14 of the sheet supply device 10 which is in direct connection with the image forming apparatus 1 should be shut off. Thus, transmission of the driving force to the second transmission mechanism 16 is interrupted, so that operation of the first and second transmission mechanisms 15, 16 in the remaining sheet supply devices 10 can be prevented.

In the embodiment described above, the clutch mechanism 14 is accommodated in the third input gear 20. However, higher noise reduction effect would be expected if the clutch mechanism 14 is accommodated in the first input gear 18, because the number of gears to rotate in the sheet supply device 10 can be reduced to a minimum.

Still however, provision of the clutch mechanism 14 at the pivot arm 17 or the first input gear 18 is difficult to achieve in view of layout. Consequently, the clutch mechanism 14 should be accommodated in the third input gear 20 or the transmission gear 21. Here, the diameter of the input gear 20 is greater than that of the transmission gear 21, and the clutch mechanism 14 is best accommodated in the third input gear 20.

Assuming that the clutch mechanism 14 is assembled to the first input gear 18, the electromagnetic clutch may be damaged because the clutch mechanism 14 is exposed to an outside. Therefore, assembly of the clutch mechanism 14 to the first input gear 18 is not appropriate. In the embodiment described above, damages to the electromagnetic clutch can be prevented because the clutch mechanism 14 and the second clutch mechanism 14A are covered with the upper surface 10A of the casing as shown in FIG. 6.

Variations of Embodiment

In the above-described embodiment, the clutch mechanism 14 is accommodated in the third input gear 20. However, the clutch mechanism 14 may be provided at a position coaxial with one of the first input gear 18, the second input gear 19, the third input gear 20, and the transmission gear 21.

In the above-described embodiment, the clutch mechanism 14 is the electromagnetic-type clutch. However, another type of clutch mechanism may be available such that a gear for transmitting the driving force is moved by an electromagnetic solenoid to interrupt transmission of the driving force.

In the above-described embodiment, the first and second transmission mechanisms 15, 16 are provided by gear trains. However, a transmission mechanism including a toothed belt and a drive shaft may be also available.

In the above-described embodiment, the image forming apparatus 1 is the electrophotographic-type device. However, an ink-jet type image forming apparatus may be also available in which minute ink droplets are ejected onto a sheet to form an image.

While the description has been made in detail with reference to the embodiments thereof, it would be apparent to those skilled in the art that many modifications and variations may be made therein without departing from the spirit of the disclosure.

What is claimed is:

1. A sheet supply device configured to be attached to and detached from an image forming apparatus, the sheet supply device being configured to receive a driving force from the image forming apparatus to supply a sheet to the image forming apparatus in response to attachment of the sheet supply device to the image forming apparatus, the sheet supply device comprising:

a main body provided with a sheet supply tray on which a sheet is mountable;

a sheet supply roller configured to be in contact with a sheet mounted on the sheet supply tray and configured to rotate to supply the sheet toward the image forming apparatus;

an external output gear;

a clutch mechanism configured to transmit and interrupt the driving force received from the image forming apparatus to the sheet supply roller and the external output gear;

a first transmission mechanism configured to transmit the driving force received through the clutch mechanism to the sheet supply roller; and a second transmission mechanism configured to transmit the driving force received through the clutch mechanism to the external output gear, the external output gear being configured to output the driving force received from the second transmission mechanism to an outside.

2. The sheet supply device according to claim 1, wherein the image forming apparatus is provided with an output gear configured to output the driving force, the sheet supply device further comprising:

a first input gear configured to be in meshing engagement with the output gear in response to attachment of the sheet supply device to the image forming apparatus;

a pivot arm having one end portion pivotally supported to the main body and another end portion at which the first input gear is provided, the pivot arm being pivotally movable about a pivot axis;

a second input gear having a rotation axis coincident with the pivot axis and in meshing engagement with the first input gear; and a third input gear supported to the main body and in meshing engagement with the second input gear, wherein the clutch mechanism is positioned coaxially with one of the first input gear, the second input gear, and the third input gear.

3. The sheet supply device according to claim 2, wherein the third input gear has a diameter greater than that of the second input gear.

4. The sheet supply device according to claim 3, wherein the clutch mechanism is positioned coaxially with the third input gear.

5. The sheet supply device according to claim 4, further comprising a transmission gear positioned coaxially with the third input gear and having a diameter different from that of the third input gear, the transmission gear being configured to transmit the driving force to the first transmission mechanism and the second transmission mechanism, wherein the clutch mechanism is an electromagnetic clutch accommodated in one of the third input gear and the transmission gear, the one of the third input gear and the transmission gear having a diameter greater than that of the other of the third input gear and the transmission gear.

6. The sheet supply device according to claim 5, wherein the clutch mechanism is accommodated in the third input gear.

7. The sheet supply device according to claim 1, wherein the first transmission mechanism comprises a second clutch mechanism configured to transmit and interrupt the driving force to the sheet supply roller.

8. An image forming system comprising:

an image forming apparatus configured to form an image on a sheet and provided with an output gear configured to output a driving force to an outside; and a sheet supply device configured to be attached to and detached from the image forming apparatus, the sheet supply device being configured to receive the driving force from the image forming apparatus to supply a sheet to the image forming apparatus in response to attachment of the sheet supply device to the image forming apparatus, the sheet supply device comprising:

a main body provided with a sheet supply tray on which a sheet is mountable;

a sheet supply roller configured to be in contact with a sheet mounted on the sheet supply tray and configured to rotate to supply the sheet toward the image forming apparatus;

an external output gear;

a clutch mechanism configured to transmit and interrupt the driving force received from the image forming apparatus to the sheet supply roller and the external output gear;

a first transmission mechanism configured to transmit the driving force received through the clutch mechanism to the sheet supply roller; and a second transmission mechanism configured to transmit the driving force received through the clutch mechanism to the external output gear, the external output gear being configured to output the driving force received from the second transmission mechanism to an outside.

* * * * *